US008444001B1

(12) United States Patent
Dawson

(10) Patent No.: US 8,444,001 B1
(45) Date of Patent: May 21, 2013

(54) PLATE WITH CUP ATTACHMENT

(76) Inventor: Michael T. Dawson, Fort Worth, TX (US)

( * ) Notice: Subject to any disclaimer, the term of this patent is extended or adjusted under 35 U.S.C. 154(b) by 0 days.

(21) Appl. No.: 13/478,544

(22) Filed: May 23, 2012

(51) Int. Cl.
*B65D 21/02* (2006.01)

(52) U.S. Cl.
USPC ..... 220/574; 220/23.86; 206/217; 206/549

(58) Field of Classification Search
USPC . 206/502, 217, 541, 549, 564, 223; 220/23.2, 220/23.4, 23.6, 759, 752, 574, 23.83, 575, 220/23.86, 379, 281, 282, 288, 480–482
See application file for complete search history.

(56) References Cited

U.S. PATENT DOCUMENTS

| | | | | |
|---|---|---|---|---|
| 2,374,092 | A * | 4/1945 | Glaser | 215/6 |
| 3,469,739 | A * | 9/1969 | Phillips | 221/96 |
| 5,058,737 | A * | 10/1991 | Patterson et al. | 206/217 |
| 5,060,820 | A | 10/1991 | Boerner | |
| 5,176,283 | A * | 1/1993 | Patterson et al. | 220/574 |
| 5,240,136 | A | 8/1993 | Patterson et al. | |
| 5,292,028 | A * | 3/1994 | Patterson et al. | 220/574 |
| 5,301,833 | A * | 4/1994 | Aycan | 221/96 |
| 5,325,962 | A | 7/1994 | Ouellette | |
| 5,749,486 | A * | 5/1998 | Porter | 220/23.86 |
| 5,954,195 | A * | 9/1999 | Krueger et al. | 206/217 |
| 6,021,903 | A | 2/2000 | Hanson | |
| 6,138,860 | A | 10/2000 | Comeaux | |
| 6,338,417 | B1 * | 1/2002 | Ferraro | 220/23.83 |
| 6,732,990 | B2 | 5/2004 | Hudson | |
| 7,115,294 | B1 | 10/2006 | Loh et al. | |
| 2004/0238537 | A1 | 12/2004 | Ojeda | |
| 2007/0264167 | A1 | 11/2007 | Warner | |
| 2008/0142528 | A1 * | 6/2008 | Lim | 220/575 |
| 2008/0257895 | A1 | 10/2008 | Broselow | |

* cited by examiner

*Primary Examiner* — Andrew Perreault
(74) *Attorney, Agent, or Firm* — Patton Boggs LLP

(57) ABSTRACT

A dinner plate of conventional size and shape includes coupling means on its planar bottom that grasps and retains flexible plastic drink cups, enabling a user to stabilize the plate atop the cup and to hold both securely with one hand. The user squeezes the cup rim and inserts it between diametrically opposing, chordal grooves of the coupling means, the cup's resiliency expanding the rim into the grooves when released. In a preferred embodiment, the coupling means is a coaxial, raised island in the plate bottom that forms a recess into which the cup rim fits, radially inward-extending lugs in the recess walls fitting under the cup rim to secure it against the plate bottom. This leaves the plate bottom flat for use on horizontal surfaces and optimizes nesting of plates for storage and stacking, as well as creating a closure for the cup.

16 Claims, 7 Drawing Sheets

PLATE WITH CUP ATTACHMENT

BACKGROUND OF THE INVENTION

1. Field of the Invention

This invention relates generally to dishware and particularly to disposable or durable dishware used in dinner party and buffet settings. More particularly, this invention relates to a plate or other flat dishware bearing coupling means on its underside adapted to couple to the rim of a flexible, disposable drink cup.

2. Description of Related Art

Party goers and buffet diners alike are familiar with the common conundrum of not having enough hands to eat and drink from their food plates and drink cups without a place to set down one or the other. In typical party settings, revelers often snack or even eat while standing and talking to others. In buffet lines, diners must move along a table gathering food choices onto their plate but seldom have a place to set their drink while they do so. Such party goers and diners may become adept at holding their cups and plates in one hand while wielding forks or serving utensils in the other. However, mastering such gymnastics isn't easy, especially for children, and just setting a loaded plate on top of a drink cup invites accidents. A need exists for plates that couple securely to drink containers to free one hand for other activities.

A number of prior art devices have been developed to address this problem. One common approach comprises plates with a scallop in one edge for inserting stem-ware such as a wine glass. Others include annular collars or other appendages extending downward from the bottom of plates that fit over the rim of a cup or glass. Still others include bayonet-like appendages on specialized cups that mate with complimentary apertures on the bottom of specialized plates. Another approach is to provide special plate-and-cup holders that couple to both containers. All of these work to some degree but present various challenges and inconveniences.

For example, most discourage or even prevent use of commonly available, inexpensive and disposable dishware, and instead require more expensive proprietary cups and plates designed only to work together. Scalloped-edge plates are relatively expensive to manufacture, and the system typically works only with stem-ware, as the aperture usually is kept small to preserve space on the top of the plate for holding food. Descending-collar devices interfere with resting the plate on a table or other horizontal surface. Further, the collar-to-cup interface may be a loose fit that invites tipping of the plate from acentric food loading unless it is secured by vigilant grasp by the user. The bayonet and aperture system is expensive and doesn't permit use of alternative cups and plates. The plate-and-cup holder devices often work with commonly available dinner plates and drink containers, but require the expense and use of a third device. A need exists for a simple plate that couples to ordinary, commonly available plastic drink cups so that both may be held in one hand, freeing the other hand for eating, serving or other activities.

SUMMARY OF THE INVENTION

A dinner plate of conventional size and shape includes within its substantially planar bottom a coaxial central region having coupling means in the form of diametrically opposing, chordal grooves that mate with the outwardly curled rim of commonly available, flexible plastic drink cups. The coupling means holds the cup snugly against the bottom of the plate, enabling a user confidently to hold both in one hand, freeing his other hand and allowing considerable acentric loading of the plate with foods. Inserting the cup rim into the grooves requires squeezing it slightly and temporarily into an oval shape. Once released, the cup's resiliency enhances the snugness of the fit and the security of the coupling. In a preferred embodiment, the central region forms a slightly raised island in the center of the plate, the island creating a recess substantially flush with the bottom of the plate, thereby abetting use of the plates on horizontal surfaces and optimizing the nesting of multiple plates for storage and stacking. Segments of the walls of the recess include radially inward-extending lugs that fit under the cup rim and secure it against the bottom surface of the recess.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DESCRIPTION OF A PREFERRED EMBODIMENT

Figure 1:
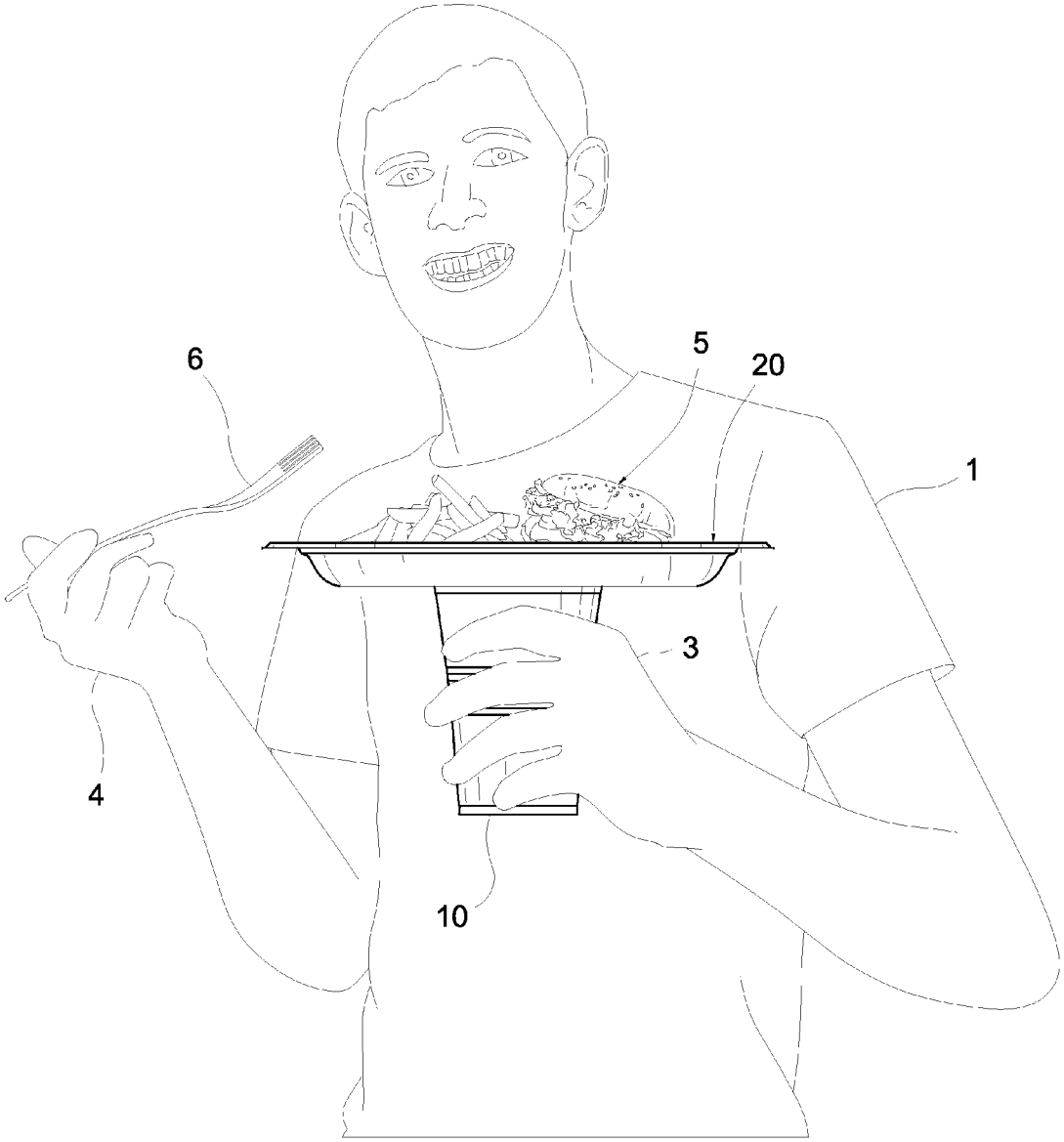
FIG. 1 shows a party goer holding the present invention in one hand while using his free other hand to eat.
Figure 2:
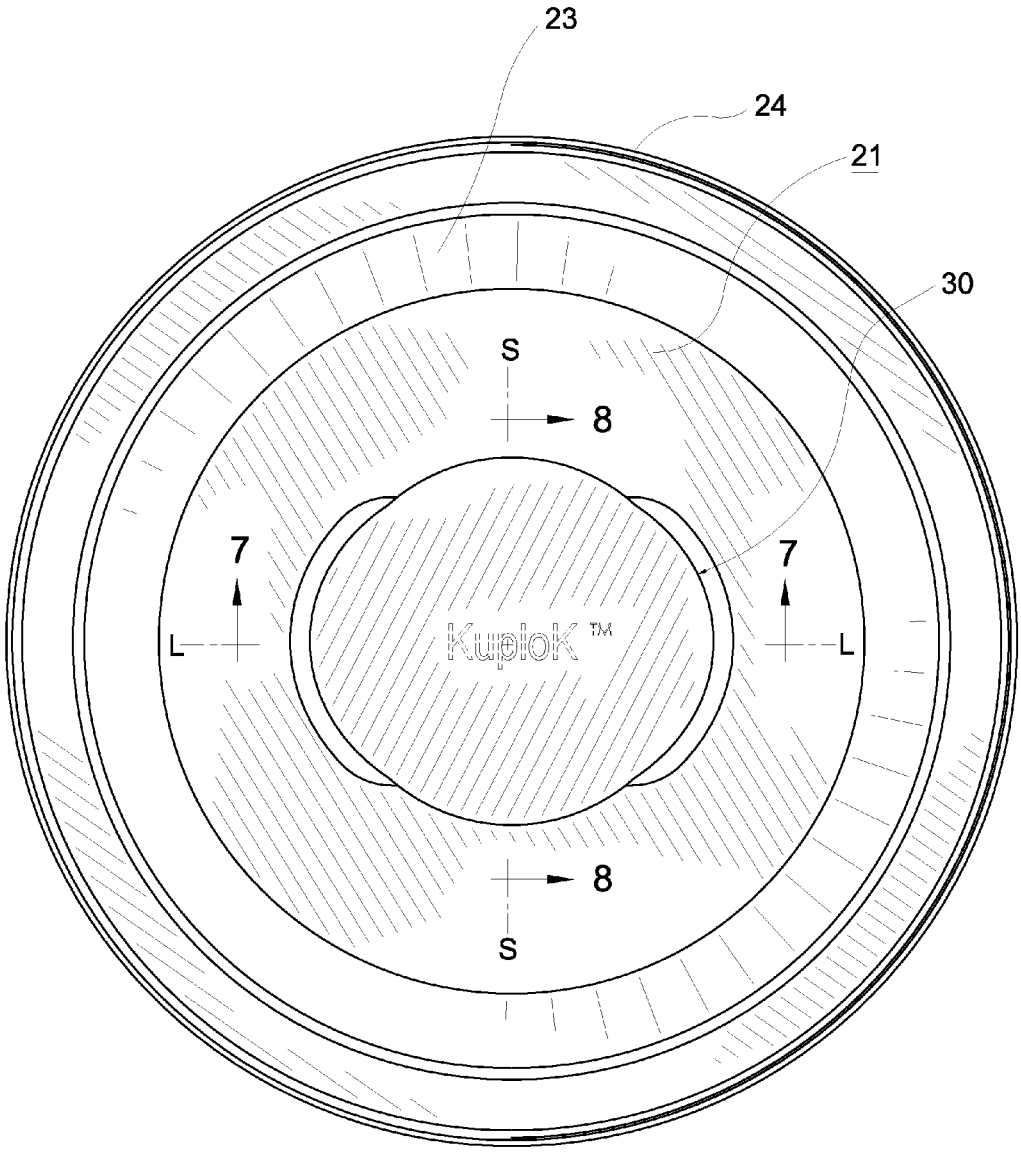
FIG. 2 shows in top plan view a plate embodying a preferred embodiment of the present invention.
Figure 3:
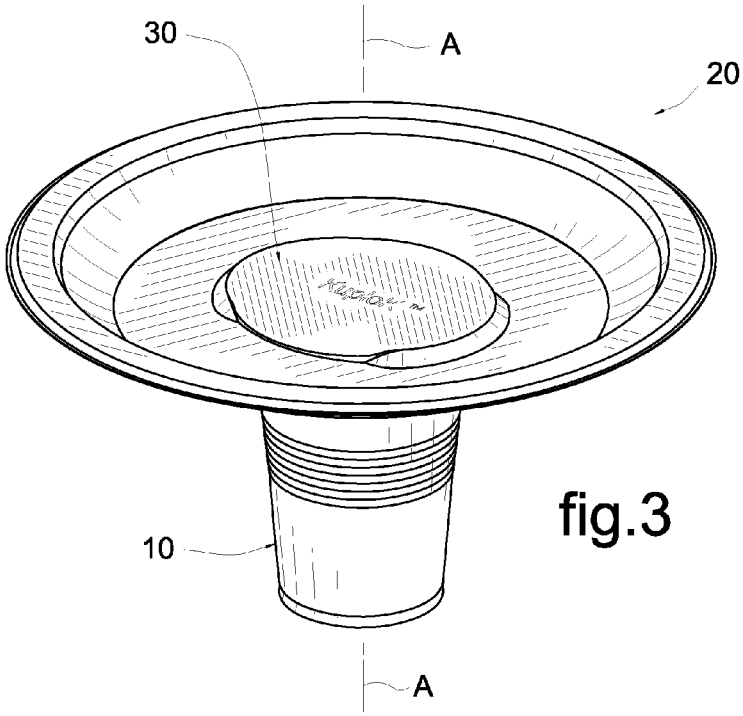
FIGS. 3-4 show in top- and bottom-quartering perspectives the plate of FIG. 2 mated to an ordinary, frustro-conical plastic drinking cup.
Figure 4:
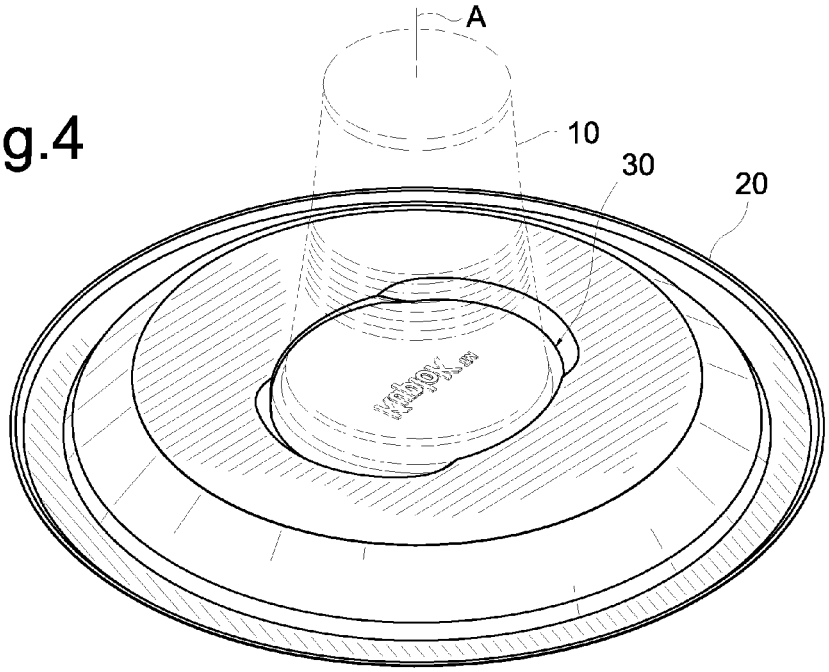

Referring now to the figures, and particularly to FIG. 1, user 1 employs the present invention to hold his plate 20 containing food 5 by grasping his drink cup 10 with one hand 3. Because plate 20 is coupled to the rim of cup 10, user 1's other hand 4 is free to handle his fork 6 or to perform other tasks without putting down his food plate 20 and drink cup 10.

Referring now also to FIGS. 2-5, cup 10 comprises a ubiquitous, inexpensive drink container commonly found in party supply stores. Cup 10 has a generally frustro-conical shape with a wide, circular mouth 13 and regular, conical walls 12 tapering toward and truncated by a narrower bottom 11. Cup walls 12 surround and define interior 14 in which typically is held a liquid beverage (not shown), often at an elevation within interior 14 close to mouth 13. Surrounding mouth 13, outwardly curled rim 15 comprises a continuation of walls 12 to form a smooth lip engaged by user 1's mouth while he drinks the contents of cup 10. Cup 10 may include grasping grooves 16 and other non-essential features such as logos and decorations (not shown) on the outside of walls 12. Cup 10 typically is made of polystyrene plastic thermoformed into the indicated shape. Cup 10 typically is geometrically stable, though flexible enough to bend and deform, as will be discussed below. One having ordinary skill in the art will recognize that other drink containers can serve equally well as cup 10 as long as they embody two traits: (1) their mouth 13 and rim 15 include a diameter substantially equivalent to dimension C (see FIG. 5) of coupling means 30 of the present invention; and (2) rim 15 and mouth 13 are sufficiently flexible and resilient that they may be deformed temporarily to the size of dimension D for insertion into coupling means 30, as discussed in detail below.

Plate 20 shares most of its features with the likewise ubiquitous party plates used in various sizes and materials by the millions annually. Plate 20 includes a substantially planar bottom having a bottom surface 21 opposite and substantially coextensive with top surface 22. Surrounding the plate bottom, shallow side walls 23 rise to a wider plate brim 24 to form a convenient, substantially open and planar container, typically intended to hold food 5 portions while user 1 enjoys eating them. Usually rested on a table or other horizontal surface, but not uncommonly held in one hand by user 1, plate 20 may be loaded on different parts of its top surface 22 with foods 5 or other objects of different densities and weights. Plate 20 thereby often becomes acentrically loaded about its vertical axis A (see FIGS. 3 and 4) This acentric loading usually presents no problem for user 1, however, because he either grasps sides 23 and brim 24 (not shown) firmly to resist the overturning effect of acentric loading, or he places plate 20 onto a horizontal surface such as a table (not shown). If user 1 has a drink in cup 10 while he eats, he usually must set cup 10 aside and hold plate 20 with one hand 3 while he eats with his other hand 3.

Coaxial with sides 23 in the center of bottom 21, 22 of plate 20, coupling means 30 permits user 1 to hold his cup 10 and plate 20 simultaneously in one hand without fear of plate 20 tipping and falling. Coupling means 30 includes on bottom 21 of plate 20 a plurality of rim grasping means adapted to surround a portion of rim 15 and to hold mouth 13 against bottom 21. This permits user 1 to deviate considerably from holding plate 20 directly upright, as long as he doesn't do so enough that food 5 becomes disengaged from plate 20. As depicted in FIG. 1, a preferred and natural manner of holding plate 20 and cup 10 simultaneously would be by gripping cup 10 in a comfortable, conventionally upright grasp. One having ordinary skill in the art will recognize, of course, that alternately user 1 could grasp plate 20 by sides 23 and brim 24 while cup 10 remains securely suspended beneath bottom 21, 22 within coupling means 30.

In a preferred embodiment, as seen also in FIGS. 6-10, coupling means 30 comprises a raised, lid portion 31 of bottom 21, 22, essentially a low, planar "island" in the middle of plate 20 surrounding axis A. Lid portion 31 surrounds and defines a shallow, oval recess 35 within bottom surface 21 just deep enough that rim 15 may be inserted. Lid portion 31's substantially oval or elliptical shape includes short axis S, along which Section 7-7 is indicated, and long axis L, along which Section 8-8 is indicated, in FIG. 2. Lid portion 31 lies in a plane substantially parallel to the plane of plate bottom 21, 22 and offset vertically thereabove by a distance substantially equivalent to the diameter of curled rim 15 of cup 10.

Figure 10:
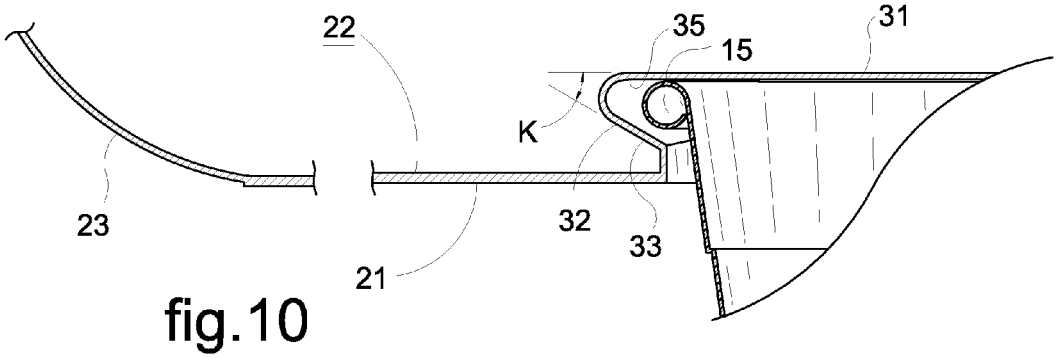
FIG. 10 details the fit of the rim of the cup into the chordal groove portion of the preferred embodiment of the present invention.

Descending between the planes of lid portion 31 and plate bottom 21, 22, recess walls 32 define the perimeter of recess 35. Formed within a chordal segment of recess walls 32 and symmetric on either side of short axis S, a pair of opposing cup rim grasping zones comprise segments of walls 32 that extend radially inward toward axis A to form rim retaining lugs 33 that terminate in noses 34 adapted to extend beneath rim 15 to a position adjacent cup walls 12. Lugs 33 thus form a groove between the bottom of lid portion 31 and nose 34 into which rim 15 reaches while engaged within recess 35. As best seen in FIG. 10, lugs 33 preferably extend at an acute angle K to lid portion 31. Preferably, angle K is between twenty (20 deg.) degrees and forty-five (45 deg.) degrees, and more preferably approximately thirty (30 deg.) degrees, but one having ordinary skill in the art will recognize that almost any angle that results in dimension D, the distance between noses 34 (FIG. 5), being shorter than dimension C (the maximum diameter of coupling means 30 adjacent lid portion 30) is considered to be within the spirit and scope of the present invention. The preferred angle K discussed above abets fabrication of plate 20 using fixed thermoform molds, as discussed in more detail below.

Lugs 33 preferably engage rim 15 along its circumference in at least four places spaced around rim 15. The chordal segments of recess walls 32 defined by lugs 33 have substantially consistent radii, making them substantially circular segments. This in turn causes the grooves formed by lugs 33 to surround corresponding chordal segments of rim 15. Further, the diametrical separation of lugs 33 preferably and advantageously is slightly less than the diameter of rim 15. Thus, the resiliency of cup 10 urges rim 15 firmly beneath lugs 33 and lends a significant friction-inducing forced fit between cup 10 and plate 20 within recess 35.

Preferably, rim 15 substantially, though not entirely, expands to match the radii of lugs 33. Because its radius preferably is slightly greater than the radii of lugs 33, rim 15 actually engages recess 35 more tightly the ends of the chordal segments of lugs 33 than at their central portions juxtaposed short axis S. This actually further enhances the snugness of the grasp of rim 15 by lugs 33. The expansive resiliency of cup 10 thereby forces rim 15 against lugs 33 a the four distinct end points of the chordal segments formed by lugs 33 instead of spreading that force over the entire arc of lugs 33. This in turn holds cup 10 more tightly and better resists moment forces that try to overturn plate 20. One having ordinary skill in the art will recognize, however, that, though substantially standardized for consistency and convenience in use in the party supplies industry, the diameter of rim 15 may vary slightly from one cup 10 to another, and the moment resistance created by lugs 33 may be more evenly distributed along lugs 33 for one cup 10 while for another cup 10 it is concentrated at the endpoints of the chordal segments defined by lugs 33.

The chordal segments of lugs 33 preferably comprise no more than half the perimeter of recess 35, and they correspondingly engage no more than half the circumference of rim 15. One having ordinary skill in the art will recognize that the length of said chordal segments is not critical as long as the ends of lugs 33 distal short axis S that engage rim 15 the tightest are angularly separated enough that they provide sufficient moment resistance to overcome forces tending to tip plate 20 and to disengage rim 15 from recess 35. Preferably, the opposite ends of said chordal segments formed by lugs 33 are separated by no less than thirty (30) degrees of arc, and no more than forty-five (45 deg.) of arc, about axis A.

Figure 6:
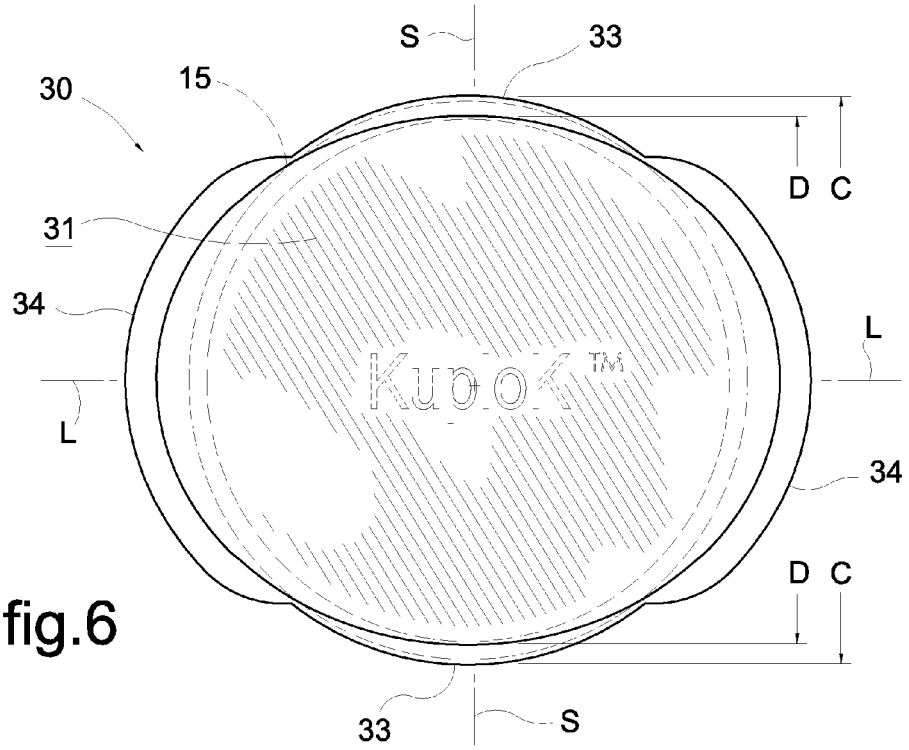
FIGS. 6-7 show in top plan view a plate's central region embodying the preferred embodiment of FIG. 2, the rim of a cup being visible in hidden line representation and illustrating its deformation while being mated with the coupling means of the present invention.
Figure 7:
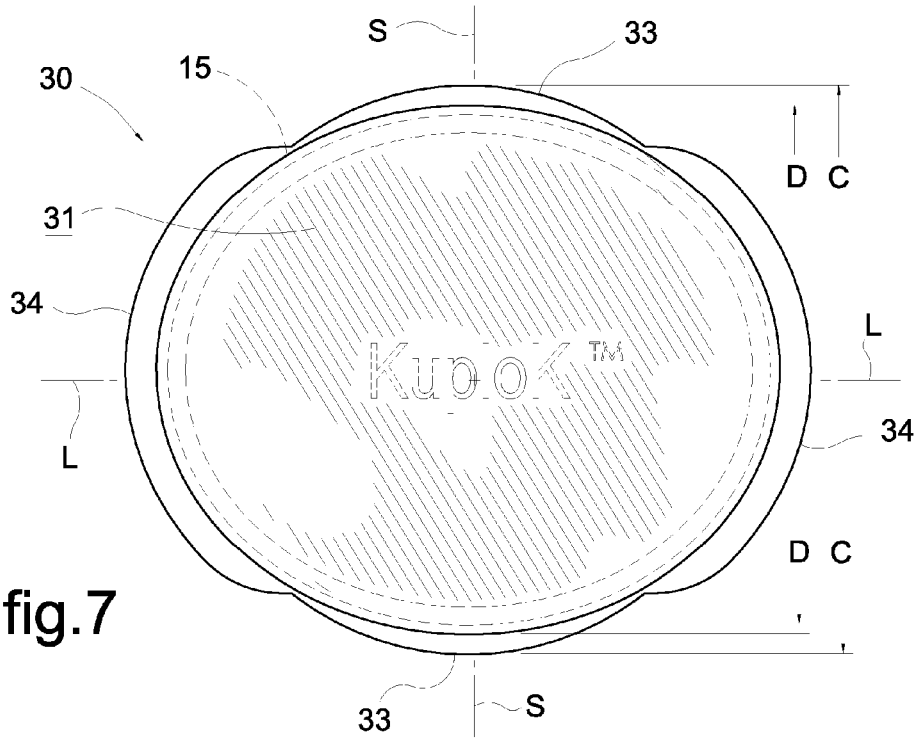
Figure 8:
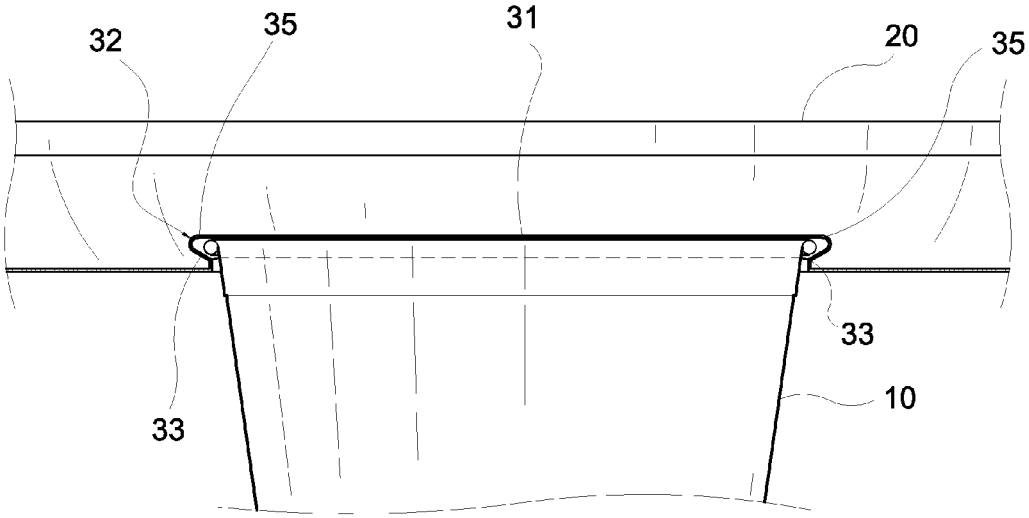
FIGS. 8-9 correspond to FIGS. 6 & 7 respectively and depict in side elevational section views as indicated in FIG. 2 the cup rim positioned into different portions of the recess of the preferred embodiment of FIG. 2.
Figure 9:
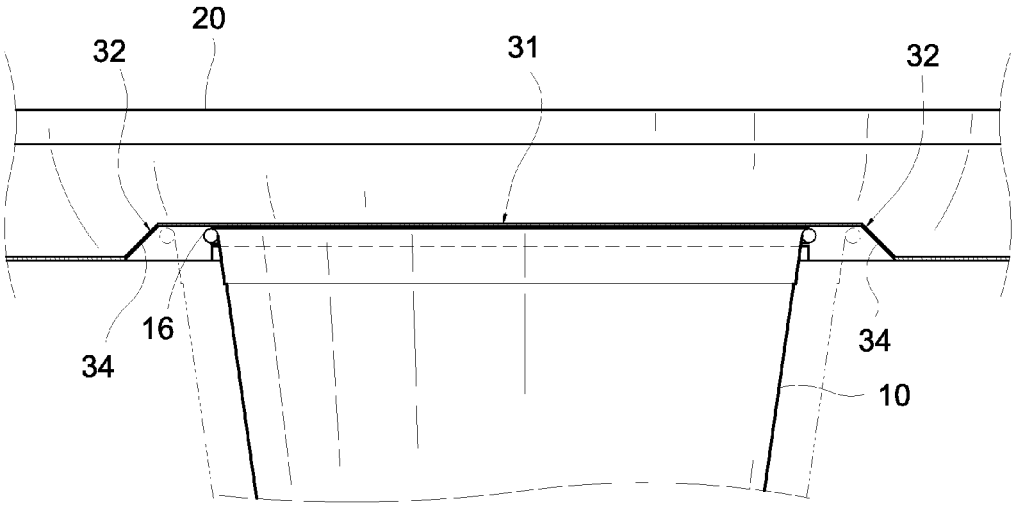

Along the remaining portions of the perimeter of recess 35, essentially two other chordal segments thereof disposed symmetrically on either side of long axis L, recess walls 32 deviate radially outward from axis A toward plate side walls 23. This forms a pair of opposing expansion zones 36 into which rim 15 may stretch while being inserted into recess 35. As best seen in FIG. 6, expansion zones 36 extend along long axis L such that the planar surface of the bottom of lid portion 31 within recess 35 exceeds the diameter of rim 15 substantially. Further, walls 32 in this region also slope radially outward away from axis A, preventing walls 32 from interfering with cup 10 as rim 15 is inserted into recess 35.

Figure 5:
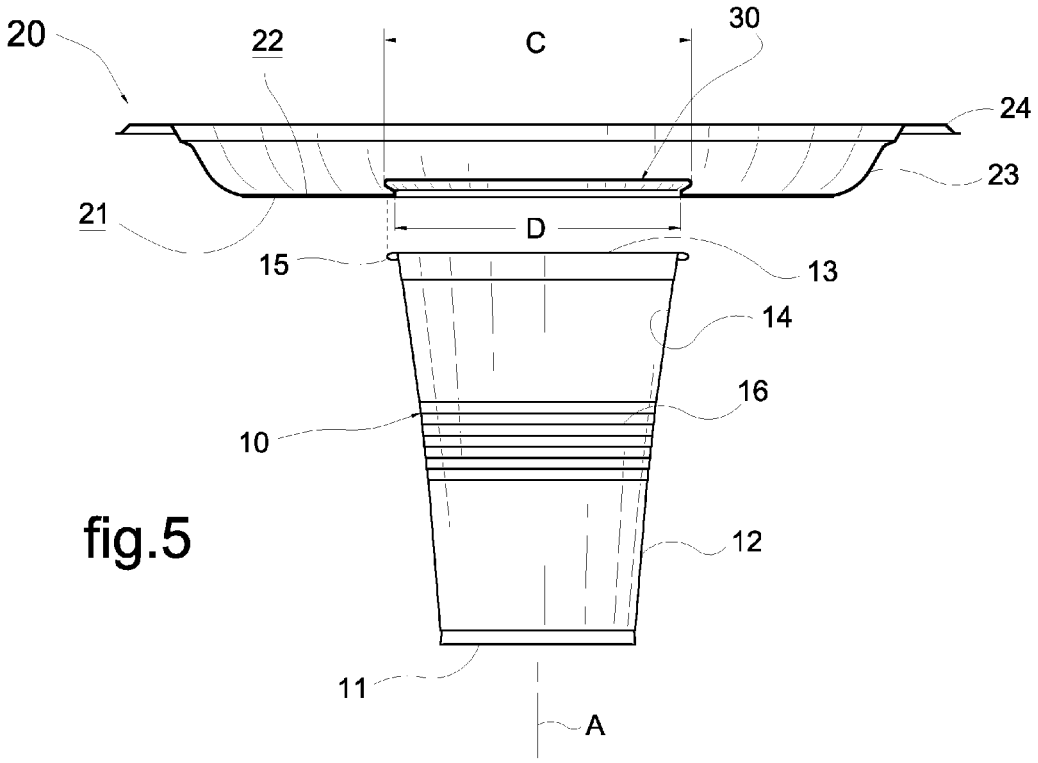
FIG. 5 details in side elevational view the comparative diameters of the cup rim and the recess coupling means of the preferred embodiment of FIG. 2.

In operation, user 1 grasps in one hand plate 20 and aligns cup 10 with axis A beneath recess 35 (see FIG. 5). User 1 then squeezes rim 15 into an oval shape with its resulting short axis parallel to axis S of recess 35 while urging cup 10 toward lid portion 31. As long as user 1 squeezes rim 15 enough that its short axis is no greater than dimension D, and positions its long axis substantially parallel to long axis L of recess 35, rim 15 will enter recess 35. Once rim 15 abuts lid portion 31, user 1 relaxes his squeezing grasp of rim 15 and allows it to expand beneath lugs 33. Cup 10 then is coupled to plate 20 securely enough that it will not fall out if user 1 releases his grasp on it altogether and hold both plate 20 and cup 10 with his other hand by plate sides 23. To remove rim 15 from recess 35, user 1 may simply pull it away from lid portion 31 and parallel axis A until it pops out, or he may squeeze rim 15 again until he can remove it more gently.

The above insertion procedure of rim 15 into recess 35 presumes substantial alignment of cup 10 with axis A, which user 1 may learn to do with practice. But even with less than perfect alignment, user 1 can insert cup 10 into recess 35 without looking beneath plate 20, and with very little practice. First, user 1 urges a first edge of rim 15, say adjacent his fingers, into substantial engagement with a first lug 33 on one side of bottom 21 of plate 20. This can be confirmed simply by rotating plate 20 slightly and feeling the ends of said first lug 33 against rim 15. Next, user 1 can look at the top of plate 20 and orient lid portion 31 so that its side opposite where he knows rim 15 already resides is directly above his thumb. To facilitate this step, he can place his thumb slightly above rim 15 so he can feel bottom surface 21 of plate 20 as he proceeds. Then, he simply squeezes rim 15 gently with his thumb while simultaneously urging the side of rim 15 adjacent his thumb toward lid portion 31 until he feels rim 15 slip into recess 15 and abut lid portion 15. Even if the resulting long axis of rim 15 is not perfectly aligned with long axis L of recess 15, when user 1 relaxes his squeezing of rim 15, it will expand and settle into the grooves formed by lugs 33 without user 1 having to consciously make it do so. To test for a successful coupling, he may tug slightly on cup 10 parallel to axis A and then turn his attention to other matters.

Figure 11:
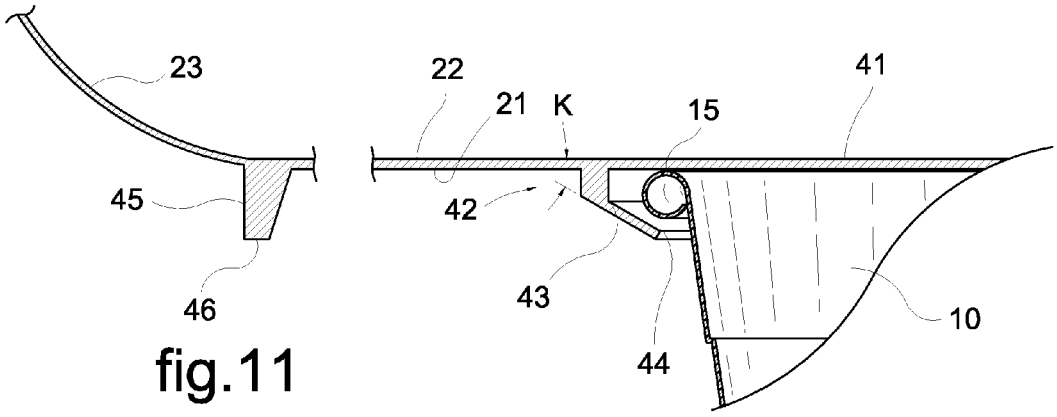
FIGS. 11-12 detail alternate embodiments to the recessed chordal grooves of the preferred embodiment of the present invention.
Figure 12:
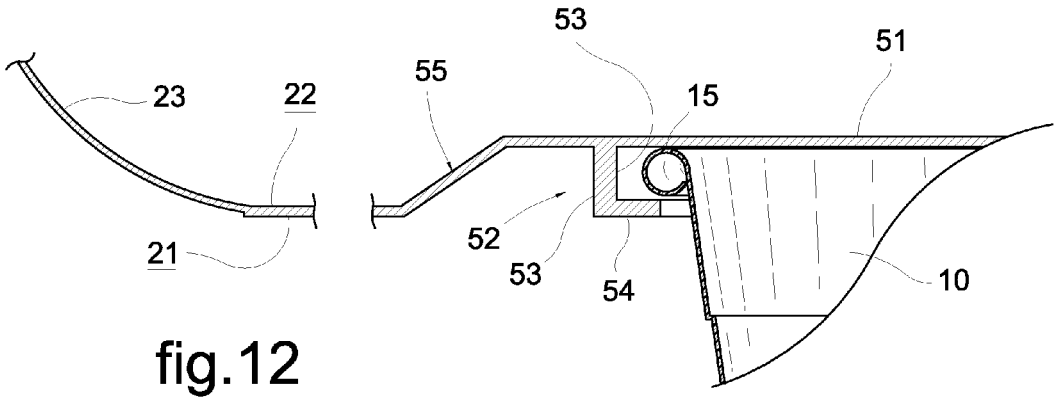

Turning next to FIGS. 11-12, alternate embodiments of the present invention appear. In FIG. 11, no recess 35 exists, and lugs 43 simply descend directly from bottom 21 of plate 20. They then turn radially inward and angle downward toward axis A to terminate in noses 44 that reach beneath rim 15 to enclose and grasp it. The angle K from lid portion 41 at which lugs 43 descend preferably is the same as described above for lugs 33 of the preferred embodiment. Further, lugs 43 extend in chordal segments (not shown) along bottom 21 substantially the same length and position as do the chordal segments defined by lugs 33 as discussed above for the preferred embodiment. Lugs 43 thereby serve the same purpose and function similarly to lugs 33, but without deforming top surface 22 of plate 20. The "expansion zone" for the temporary long axis of rim 15 comprises the entire bottom 21 of plate 20 outside of the reach of lugs 43.

Since lugs 43 are not recessed into bottom 21, however, they could interfere with using plate 20 on a flat surface such as a table. To overcome this potential problem, an annular plate resting region surrounds coupling means 30 to hold a substantial portion of the weight of plate 20 burdened with food 5. In this embodiment, such annular plate resting region comprises rails 45 descending substantially normal to plate bottom 21 and terminating in heels 46 separated substantially the same distance from bottom 21 as noses 44 of lugs 43. Rails 45 thus engage any horizontal surface onto which plate 20 is placed and provide a full resting surface for plate 20 that prevents it from becoming unstable.

Preferably, rails 45 comprise an annular ridge surrounding entirely bottom 21 of plate 20 juxtaposed plate sides 23. One having ordinary skill in the art will recognize, however, that rails 45 may comprise only chordal segments of such an annular ridge, or may comprise very short segments thereof between which gaps may exist, as long as the segments are distributed around the perimeter of plate 20. One having ordinary skill in the art will recognize, too, that the radial displacement from axis A of rails 45, and the number of concentrically arrayed rails 45 employed, may vary without departing from the spirit and scope of the present invention.

In FIG. 12, an alternate shape for lugs 43 is displayed. Instead of descending only a portion of the diameter of rim 15 and then turning to angle radially inward toward axis A (as in FIG. 10), lug 53 comprises a rectangular in shape. Lug 53 descends normal to bottom 21 the full diameter of rim 15 and then turns perpendicularly inward toward axis A and cup walls 12, thereby forming flange 54 having a substantially flat lower surface on which plate 20 can rest when placed onto a horizontal surface. In cooperation with rail 45, this configuration may provide a more stable inner support for plate 20 than lugs 43. One having ordinary skill in the art will recognize that other shapes for lugs 33, 43, 53 may be employed without departing from the spirit and scope of the present invention.

Also referring to FIG. 12, another alternate embodiment of the present invention does not rely upon rails 45. In their place, the annular plate resting region comprises a portion of bottom 21, 22 of plate 20 surrounding lid portion 51, separated therefrom by bevel 55. This results in most of bottom 21, 22 having substantially the same vertical displacement below lid portion 51 as does flange 54. Instead of plate 20 in this embodiment having distinct rails 45, the same purpose is served by simply forming plate bottom 21, 22 to become an annular plate resting region shaped as a trough surrounding lid portion 51.

One having ordinary skill in the art will recognize that the portion of plate bottom 21, 22 surrounded by the trough effectively becomes another recess, less distinctly defined as recess 35, within which the present invention is disposed. This is especially true if bevel 55 is close to lugs 53 and steep enough that the greatest portion of bottom 21, 22 of plate 20 is displaced to the level of flange 54. One having ordinary skill in the art will recognize, too, that variations in this configuration, such as narrow versus wide troughs, and segmented troughs that together surround central portion 51 but which also are separated from each other by baffles (not shown), are possible alternative configurations, and that all such variations fall within the spirit and scope of the present invention.

Preferably, plate 20 embodying the preferred embodiment or any alternate embodiments, is fabricated using thermoform molding techniques and made from one of a number of possible thermoplastic hydrocarbons such as polyethylene or polystyrene that permit the use of fixed molds to form recess 35 and lugs 33, 43, 53. One having ordinary skill in the art will recognize, however, that in some party or dinner settings, a more rigid and higher quality plate 20 may be desirable. In such case, plate 20 may be made of one of a number of possible thermoset hydrocarbons such as polystyrene, and formed in injection molds that can form more rigid lugs 33, 43, 53.

The present invention, as shown and described, provides an apparatus and method for improving serving dishes in, among other things, party and buffet settings. Employing plate 20 embodying the present invention, user 1 confidently may carry his plate of food around in one hand 3 at a party venue, with plate 20 securely coupled to rim 15 of cup 10 by lugs 33, 43, 53, without risk of spilling its contents because he failed to maintain sufficient vigilance and plate 20 tipped over. Should another user (not shown) accidentally bump user 1's arm 3, plate 20 is unlikely to fall. Further, user 1 may periodically employ his opposite hand to grasp plate 20 while he squeezes rim 15 of cup 10 gently and disengages it from lugs 33, 43, 53 long enough to take a drink or refill it and then return it to positive engagement with lugs 33, 43, 53.

While the invention has been particularly shown and described with reference to preferred and alternate embodiments, it will be understood by those skilled in the art that various changes in form and detail may be made therein without departing from the spirit and scope of the invention. For example, plate 20 has been described as being fabricated from a geometrically stable but flexible plastic material easily formed using fixed thermoform molds. Plate 20 could, however, be fabricated from paper, glass or other materials, with concomitant changes (such as movable parts) in the molds by which it is formed.

Further, cup 10 has been depicted and discussed as having an outwardly curled rim 15 having a substantially circular, vertical cross section. Cup 10 instead could be rimless and still fit snugly between lugs 33, 43, 53 and function similarly. Where this is the case, lugs 33, 43 could be shaped so that their radially inward descent is at an angle that closely matches the conical taper of sides 12 of cup 10.

Still further, plate 20 need not be circular, but could have other shapes, and coupling means 30 could be offset to one side or a corner (none shown). Further yet, coupling means 30 may be provided on other dishware, such as bowls, saucers or serving trays (none shown) instead of just plates 20. Further still, though the invention has been discussed in the context of dishware bearing food cargo, coupling means 30 could be incorporated into other containers for other applications, such as a caddy for gathering small objects from bins in a warehouse.

Finally, one having ordinary skill in the art will recognize that plate 20 effectively comprises a lid, cap or other closure for cup 10, securing the contents of interior 14 that otherwise is open at the top through mouth 13. Thus, the size and shape of plate 20 could be modified in furtherance of this cup 10 closure function and less resemble a food plate. Still, it could provide a tray-like function for placing small objects or utensils on top of cup 10.

I claim:

1. An improved dinner plate adapted to couple to a flexible drinking cup, the plate having a plate bottom with a bottom surface and surrounded by a plate rim, the flexible drinking cup having cup walls extending between a cup bottom and a cup mouth, said cup mouth having a cup mouth diameter and surrounded by a cup rim, the improvement comprising:

coupling means disposed on the bottom surface for coupling the plate to the flexible drinking cup, said coupling means comprising:

perimeter walls forming an ovate perimeter, wherein the perimeter walls surround the perimeter a coupling means axis normal to said bottom surface;

the ovate perimeter disposed on said bottom surface and having a long perimeter axis and a short perimeter axis, wherein the long perimeter axis and the short perimeter axis are orthogonal to one another and cross substantially at a center portion of the dinner plate; and at least two arcuate lugs disposed at opposite ends of said short perimeter axis, the lugs descending a spaced offset distance from said bottom surface to form grooves in a portion of said perimeter adapted to receive and hold said cup rim against said bottom surface; and cup rim expansion zones formed at opposite ends of said long axis of the ovate perimeter by a portion of the perimeter walls, wherein the cup rim expansion zones are sized and configured to receive portions of the flexible drinking cup when the flexible drinking cup is squeezed to cause the cup mouth to assume an ovate shape.

2. The improved dinner plate of claim 1 wherein said arcuate lugs converge toward said coupling means axis as the arcuate lugs descend.

3. The improved dinner plate of claim 1 wherein said arcuate lugs descend at an acute angle to said bottom surface of between twenty and forty-five degrees.

4. The improved dinner plate of claim 1 wherein said perimeter walls terminating at a planar lid portion disposed above and parallel to said bottom surface a spaced distance.

5. The improved dinner plate of claim 4 wherein said arcuate lugs and said cup rim expansion zones form two pairs of opposing segments of said perimeter walls.

6. The improved dinner plate of claim 4 wherein each of said rim expansion zones further comprises a planar portion of said planar lid portion extending on opposite sides of said long perimeter axis a spaced distance beyond said arcuate lugs; and arcuate beveled walls coupled to said planar portion and extending divergently away from said coupling means axis to intersect said bottom surface.

7. The improved dinner plate of claim 1 and further comprising annular plate resting means disposed on said plate bottom radially distal said coupling means.

8. The improved dinner plate of claim 7 wherein said annular plate resting means comprises a ridge disposed adjacent said plate rim and extending normal to said plate bottom a spaced distance equivalent to the offset distance said arcuate lugs descend from said bottom surface.

9. The improved dinner plate of claim 7 wherein said annular plate resting means comprises a trough surrounding said coupling means and adapted to contain foodstuff placed onto said plate.

10. An improved dinner plate adapted to couple to a flexible drink container, the plate having a substantially planar bottom surrounded by a plate rim, the flexible drink container having container walls extending between a container bottom and a mouth, said mouth having a mouth diameter and surrounded by a mouth rim, the improvement comprising;

a container coupler comprising:

a coupler axis normal to said bottom surface;

coupler walls surrounding and defining an ovate recess disposed within said planar bottom, said ovate recess having a short recess axis and a long recess axis, wherein said short recess axis and said long recess axis cross perpendicularly, said coupler walls extending above said planar bottom to terminate at a coupler lid disposed parallel to said bottom surface;

at least one pair of diametrically opposing container rim grasping lugs disposed within said coupler walls symmetric about said short recess axis and descending at an acute angle from said coupler lid to converge toward said coupler axis; and mouth rim expansion zones disposed within said coupler walls astraddle each end of said long recess axis, the rim expansion zones each comprising:

a planar region coplanar with said coupler lid and extending a spaced distance distal the coupler axis and beyond the ends of said rim grasping lugs; and beveled zone walls extending from said planar region toward said planar bottom and diverging from said coupler axis.

11. The improved dinner plate of claim 10 wherein said container rim grasping lugs descend at an acute angle of between twenty and forty-five degrees.

12. The improved dinner plate of claim 11 wherein said container rim grasping lugs descend at an acute angle of substantially thirty degrees.

13. The improved dinner plate of claim 10 wherein said container rim grasping lugs extend within said coupler walls for an angular distance of between thirty and forty-five degrees of arc around said coupler axis.

14. The improved dinner plate of claim 11 wherein said container rim grasping lugs have radii equal to less than half the mouth diameter.

15. An improved method of eating and drinking without sitting at a table, the improved method comprising:

providing a flexible drinking cup containing a liquid drink, the flexible drinking cup comprising:

a cup mouth coaxial with a cup axis and surrounded by a resilient cup rim; providing a plate comprising:

a plate bottom surrounded by plate sides;

a coupler disposed within said plate bottom comprising:

a coupler axis normal to said plate bottom;

coupler walls surrounding and defining a ovate recess within in said plate bottom, said recess having a short recess axis and a long recess axis;

cup rim grasping lugs disposed within and forming a pair of arcuate segments of said coupler walls astraddle both ends of said short recess axis, said grasping lugs extending at an acute angle to said plate bottom to diverge toward said coupler axis; and cup rim expansion zones within said coupler walls and disposed between said grasping lugs and astraddle said long recess axis;

grasping said flexible drinking cup adjacent the resilient cup rim and holding the flexible drinking cup substantially upright;

disposing said plate above said cup with said coupler axis substantially aligned with said cup axis;

squeezing said drinking cup to deform its cup mouth and cup rim into a ellipse having a cup rim short axis and a cup rim long axis;

aligning said cup rim long axis with said coupler recess long axis;

urging said cup rim into said coupler recess; and releasing said drinking cup and allowing its resiliency to expand said cup rim toward and into said rim grasping lugs.

16. The improved method of claim 15 wherein the urging step further comprises:

engaging a first cup rim segment within one of said cup grasping lugs;

orienting said cup long axis parallel to said recess long axis; and urging a second cup rim segment opposite said first cup rim segment toward the plate bottom until it is in planar alignment with the other of said cup grasping lugs.

* * * * *